US005131823A

United States Patent [19]

Guignard

[11] Patent Number: 5,131,823

[45] Date of Patent: Jul. 21, 1992

[54] DEVICE FOR JOINING A CONNECTION PIECE TO PERISTALTIC PUMP

[75] Inventor: Claude Guignard, St-Genis Pouilly, France

[73] Assignee: Orthoconcept S.A., Switzerland

[21] Appl. No.: 670,864

[22] Filed: Mar. 18, 1991

[30] Foreign Application Priority Data

Mar. 28, 1990 [EP] European Pat. Off. ..... 90810248

[51] Int. Cl.[5] ..... F04B 43/12

[52] U.S. Cl. ..... 417/477; 248/74.1; 285/61

[58] Field of Search ..... 417/474, 475, 476, 477; 138/106; 285/61; 248/74.1, 65

[56] References Cited

U.S. PATENT DOCUMENTS 3,437,050 4/1969 Hrdina ..... 417/476 X
3,502,034 3/1970 Pickup ..... 417/477 X
3,567,345 3/1971 Ballentine ..... 417/477
4,585,399 4/1986 Baier ..... 417/477

FOREIGN PATENT DOCUMENTS 1550927 12/1968 France .

*Primary Examiner*—Leonard E. Smith
*Attorney, Agent, or Firm*—Cushman, Darby & Cushman

[57] ABSTRACT

This device includes a support (14) provided with a semicylindrical seat (15) intended to receive a connection piece segment (12). This segment (12) has a semicircular collar (170) inclined with respect to the axis of the connection piece and intended to penetrate into a groove (16) having the same inclination as the collar (17) with respect to the axis of the semicylindrical seat 15. As a result, when a traction force is exerted by the pump on the portion of the connection piece, and the collar (17) engages the groove (16), this force tends to press the segment (12) against the seat (15) and cause self-locking of the assembly.

3 Claims, 1 Drawing Sheet

DEVICE FOR JOINING A CONNECTION PIECE TO PERISTALTIC PUMP

The present invention relates to a device for joining a connection piece to a peristaltic pump, including a support that has a seat open at the side, the shape of which is complementary to that of part of the connection piece, the latter having an axial abutment element intended to be pressed against one face of the support intersecting the axis of the seat, in order to axially retain the connection piece on the support counter to the force of traction exerted by the peristaltic pump on the connection piece.

This joining device generally includes a support in which a semicylindrical seat is made, to which access can be gained laterally via an opening parallel to a longitudinal axis of the seat, but the width is less than the diameter of the cross section of this seat. To introduce the connection piece portion into this seat, it must be crushed slightly until it arrives in the semicylindrical portion where the connection piece can then resume its original shape under the influence of its inherent elasticity. The opening for access to the seat has a width less than the diameter of the seat, to prevent the accidental expulsion of the tube. In effect, by the action of pinching and relaxing that the rollers of the peristaltic pump exert upon a portion of the connection piece, the connection piece could accidentally be expelled from its seat. Since the pump rollers also exert a traction force on the connection piece, the connection piece also includes a collar that is pressed against one face of the support oriented transversely to the seat.

This joining device has various disadvantages. Placement of the connection piece in the seat of its support requires crushing of the tube, as has been noted. This operation is not always easy to do, especially since the collar that cooperates with the support is generally molded, such that only a sufficiently flexible part of the connection piece, far from this collar, can be crushed and thus it is necessary to cause the collar to slide in the seat in order to make it abut against the transverse bearing face of the support. Another disadvantage of this joining device is due to the fact that there is nothing to prevent inversion of the connection piece when it is assembled. One must in fact know that a connection piece of this kind is generally made up of various segments assembled together, each segment being made of a plastic material appropriate to its function. Thus the segment that must be associated with the saddle and with the crushing rollers of the peristaltic pump has well defined properties, such that inversion would impair its proper functioning. Applications also exist in which two separate conduits terminate at the upstream end of the pump via a Y-connection piece, and command valves serve to selectively connect one or the other of these conduits with the pump. It is apparent that in this case each conduit has a distinct function, and consequently the branches of the Y associated with each of these conduits must not be inverted. Now the joining device mentioned above does not make it possible to determine the position of these two branches, and the user must take care to assure himself that the respective branches are connected to the correct functions.

This question of assembly of the connection piece assumes particular importance, especially in the medical field, since this connection piece must then be changed upon each intervention. From this fact it becomes apparent that the above disadvantages assume increased importance, given the frequency with which this assembly operation is performed and the repercussions that may arrive if any mistake is made in this area.

The object of the present invention is to at least in part overcome the above disadvantages.

To this end, the subject of this invention is a device for joining a connection piece to a peristaltic pump including a support having a seat open at the side, the shape of which is complimentary to that of part of the cross section of the connection piece, the connection piece having an axial abutment element intended to be pressed against a face of the support intersecting the axis of the seat, to retain the connection piece axially on the support counter to the force of traction exerted by the peristaltic pump on the connection piece, characterized in that the abutment element extends obliquely with respect to the longitudinal axis of the connection piece segment to which it is attached, the support surface against which the abutment element is to be pressed forming an acute angle with the direction of the force of traction exerted by the pump on the connection piece segment positioned in the seat.

The accompanying drawings schematically show an exemplary embodiment of the joining device that is the subject of the present invention.

Figure 1:
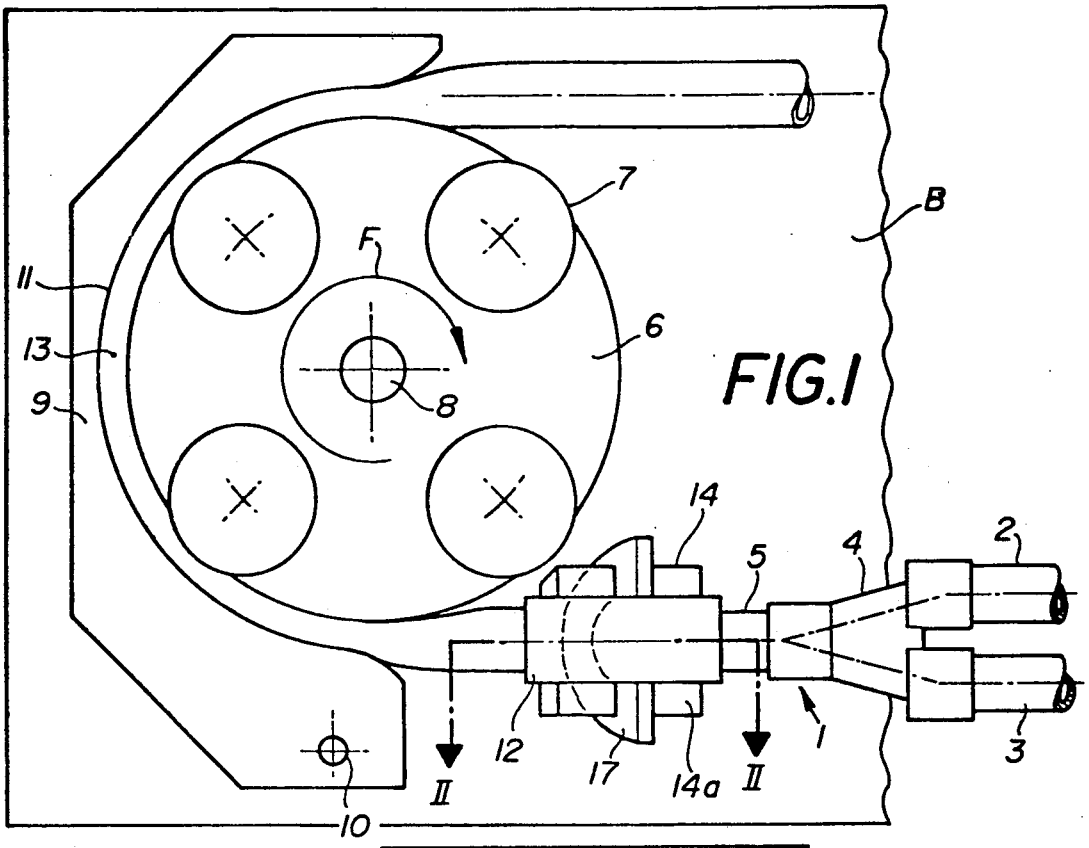
FIG. 1 is a front view of a peristaltic pump and the joining device.

FIG. 1 shows a connection piece 1, including two conduits 2 and 3 connected by a Y-piece 4 to a common conduit 5 located upstream of a peristaltic pump, of which only those parts necessary for comprehension of the invention have been shown, that is, a moving part 6 carrying rollers 7 distributed circularly around the axis of rotation 8 of the moving part 6, and a saddle 9 mounted to pivot about an axis 10, all these parts being solidly attached to a frame B. The saddle 9 has a semicircular surface 11 that is concentric with the moving part 6. A spring (not shown) serves to elastically keep this saddle 9 in a predetermined position with respect to the moving part 6. One segment 13 of the connection piece 1 is placed between the semicircular surface 11 of the saddle 9 and the moving part 6. The spacing between the moving part 6 and the saddle 9 is selected such that each roller 7 jointly compresses a portion of the wall of the segment 13 in proportion to the displacement of the roller 7 in the direction of the arrow F, opposite the semicircular surface 11 of the saddle 9. The length of this surface 11 is greater than the spacing between two rollers, and so it follows that by the well known peristaltic drive mode, a volume of liquid is thus advanced in the direction of the arrow F via each roller 7 that is displaced along the semicircular surface 11.

Figure 2:
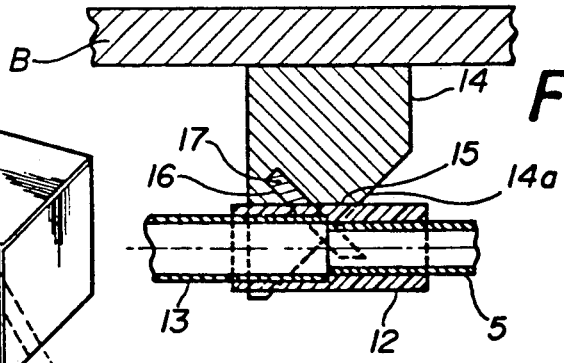
FIG. 2 is a view taken along the line II—II of FIG. 1.
Figure 3:
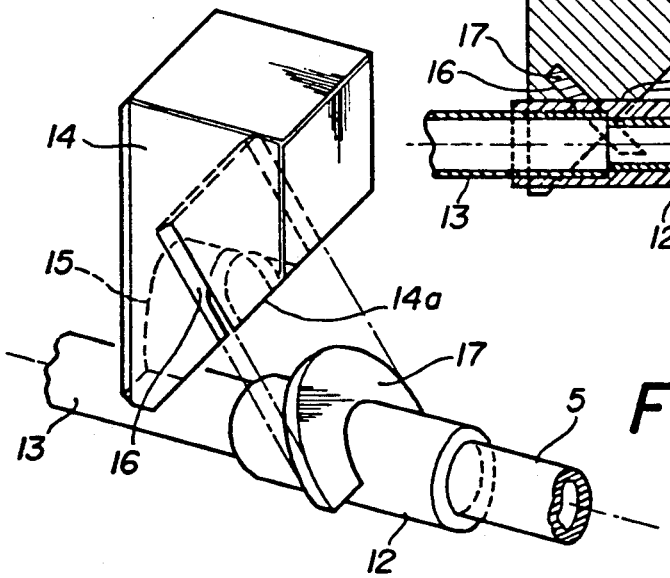
FIG. 3 is a perspective view showing the device in two separate parts.

A support device 14 is fixed to the frame B on the upstream side of the peristaltic pump. This support 14 is arranged to enable the joining of the connection piece 1 and to this end includes a semicylindrical seat 15, the diameter of which corresponds to that of the portion of the connection piece that this seat is intended to receive. This support 14, which is of generally parallelepiped shape, is intersected by an oblique face 14*a*, which intersects the semicylindrical seat 15. A groove 16 extends perpendicularly to this oblique face 14*a*, passes through the semicylindrical seat 15, and penetrates the support 14, as shown in FIGS. 2 and 3. This same drawing figure shows that the portion 12 of the connection piece that adjusts within the semicylindrical seat 15 serves to connect the segments 5 and 13 and includes a semicircular half collar 17, which with the longitudinal axis of the connection piece segments 5 and 13 forms the same acute angle as that between the groove 15 and the longitudinal axis of the semicylindrical seat 15.

As seen in FIGS. 1 and 2, the half collar 17 engages the groove 16 when the connection piece portion 5 is placed in the seat 15 of the support 14. Given their inclination, the groove 16 and the half collar 17 assure retention of the connection piece portion 5 in the semicylindrical seat 15. In fact, any traction exerted on this connection piece portion 12 after the rotation of the moving part 6 in the direction of the arrow F is translated, because of the inclination of the groove 16 and of the half collar 17, into a force component that is exerted upon the connection piece portion 12, perpendicular to its longitudinal axis and toward support 14, causing self-locking of the connection piece. Thus the connection piece portion 12 is not at risk of accidentally leaving its seat 15, so that the lateral opening that enables access to this semicylindrical seat 15 may have a width equal to the diameter of the cylindrical cross section of the seat 15, since the connection piece is retained by the aforementioned force component.

It has already been indicated above that another role of the inclined half collar 17 is to prevent inversion of the connection piece. It can be stated in fact that the joining device described prevents any inversion of the connection piece. This is also true for the inversion of the parts of the connection piece 1 located to the right and left of the support 4, and for the position of the conduits 2 and 3 ended at the Y-piece 4, in the event that such a piece is present. It will be understood that the invention is equally valid when such a Y-piece 4 is not present, and the connection piece includes only a single conduit 5 upstream of the support 14. It is equally apparent that the half collar 17 may for example be replaced with a simple oblique pin engaging a corresponding bore made in place of the groove 16.

I claim:

1. A device for joining a connection piece to a peristaltic pump, including a support (14) having a seat (15) open at the side having a shape complementary to that of part of a cross section of a connection piece (1), the connection piece having an axial abutment element (17) intended to be pressed against a face (16) of said support intersecting the axis of said seat (15), to retain the connection piece (1) axially on the support (14) counter to the force of traction exerted by the peristaltic pump (6–11) on the connection piece (1), characterized in that the abutment element (17) extends obliquely with respect to the longitudinal axis of the connection piece segment (12) to which it is attached, said support surface (16) against which said abutment element is to be pressed forming an acute angle with the direction of the force of traction exerted by said pump(6–11) on the connection piece segment (12) positioned in said seat (15).

2. The device of claim 1, characterized in that said abutment element (17) extends substantially on one side of a diametral plane passing along the longitudinal axis of the connection piece segment (12) to which it is attached.

3. The device of claim 1, characterized in that the lateral opening giving access to said seat (15) has a width equal to the cross section of the connection piece segment (12) engaging this seat (15).

* * * * *